US005414871A

United States Patent [19]

Stevens

[11] Patent Number: 5,414,871

[45] Date of Patent: May 16, 1995

[54] SOFA SLEEPER DECK WITH WELDED GRID PANELS

[75] Inventor: John Stevens, Carthage, Mo.

[73] Assignee: L & P Property Management Company, Chicago, Ill.

[21] Appl. No.: 166,083

[22] Filed: Dec. 10, 1993

[51] Int. Cl.[6] ..... A47C 17/13

[52] U.S. Cl. ..... 5/13; 5/28

[58] Field of Search ..... 5/13, 12.1, 28, 29, 5/30, 31, 37.1, 41, 42, 42.1, 43, 51.1

[56] References Cited

U.S. PATENT DOCUMENTS

| | | | |
|---|---|---|---|
| 131,675 | 9/1872 | Flynt . | |
| 981,888 | 1/1911 | Smith . | |
| 3,151,342 | 10/1964 | McLean | 5/29 |
| 3,880,413 | 4/1975 | Platt et al. | 5/247 |
| 4,086,671 | 5/1978 | Lane | 5/13 |
| 4,176,414 | 12/1979 | Wright et al. | 5/13 |
| 4,381,570 | 5/1983 | Schneider | 5/13 |
| 4,447,921 | 5/1984 | Greenblatt | 5/13 |
| 4,571,755 | 2/1986 | Stevens | 5/13 |
| 4,584,727 | 4/1986 | Reiss et al. | 5/13 |

FOREIGN PATENT DOCUMENTS

| | | | |
|---|---|---|---|
| 4019215 | 2/1991 | Germany | 5/28 |

*Primary Examiner*—Alexander Grosz
*Attorney, Agent, or Firm*—Wood, Herron & Evans

[57] ABSTRACT

An improved sofa-sleeper deck includes a number of serially interconnected welded grid panels secured to a foldable bed frame. Each panel is hingedly interconnected to the adjacent panel to form the deck of a sofa-sleeper structure. Each welded grid panel comprises a series of spaced, parallel, longitudinal wires and a series of spaced, parallel, transverse wires, all of which are welded at their intersections. A border wire extends around the perimeter of each wire grid panel and is welded at its intersections to both the longitudinal and transverse wires. In order to hingedly interconnect the panels, the longitudinal wires of at least one panel extend beyond the end of the border wire and are wrapped about the border wire of the adjacent panel.

8 Claims, 2 Drawing Sheets

SOFA SLEEPER DECK WITH WELDED GRID PANELS

BACKGROUND OF THE INVENTION

This invention relates to a combination sofa-sleeper bed, and, more particularly, to an improved sofa-sleeper deck structure.

Sofa-sleepers are well known in the prior art. Basically, a sofa-sleeper includes a foldable bed frame which supports a mattress when the bed frame is extended to a generally flat, bed configuration. The sofa-sleeper is adapted for use as a sofa when the bed frame is folded up into a storage configuration within the framework of the sofa to permit use of the structure as a seating surface. One such prior art sofa-sleeper is illustrated in U.S. Pat. No. 3,954,153 issued on Dec. 17, 1974, and assigned to the assignee of this invention.

Sofa-sleeper structures known in the prior art generally include a wire mesh or wire grid attached to the foldable bed frame. The wire grid either extends the full length of the foldable bed frame or a major portion thereof, the remainder being made from cloth, as disclosed in U.S. Pat. No. 2,878,490 issued to Schneider. This wire grid, or wire and cloth grid, is generally connected with the sides and at least one end member of the bed frame by a plurality of tension springs in order to maintain the grid in a taut and partially resilient posture when the frame is unfolded for use as a bed.

However, whether the sleeping surface of a sofa-sleeper is constructed from wire only or from wire and cloth, it has always been considered a compromise and a less satisfactory sleeping surface than a standard bed. Primarily, the shortcoming of a sofa-sleeper deck has been the tendency of the wire grid to sag when a person rests prone atop the unfolded bed. The wire grid, or wire and cloth grid, does not maintain the sofa-sleeper deck in a sufficiently taut and resilient manner to avoid sagging of the unfolded sofa-sleeper.

One prior art solution to the problem of sag in a sofa-sleeper deck is described in U.S. Pat. No. 4,584,727 which discloses a sofa-sleeper deck wherein the deck is divided up into head, body, intermediate and foot sections. The foot section is comprised of a plurality of sinuous wires; whereas, the remaining sections can be constructed of plywood as either solid panels, individual slats, or pairs of slats. However, the problem associated with a sofa-sleeper deck of such construction is that the panels constructed of plywood are excessively rigid and therefore uncomfortable for sleeping. Furthermore, a sofa-sleeper constructed with such a deck is extremely heavy, costly, and difficult to move and transform to and between the sofa configuration and the sleeper configuration.

SUMMARY OF THE INVENTION

It has therefore been an objective of this invention to provide an improved sofa-sleeper deck which provides a comfortably resilient sleeping surface to support a mattress thereon.

It has been a further objective of this invention to provide a sofa-sleeper deck with serially interconnected and individually articulating panels which can be economically manufactured and easily moved and transformed to and between the sofa and sleeper configurations.

In accordance with these objectives, the improved sofa-sleeper of this invention comprises a foldable bed frame which unfolds and extends to provide a generally flat horizontal bed or collapses and retracts into the sofa to provide a seating section. When extended into the bed configuration, the sofa-sleeper deck includes head, body, intermediate and foot panels which are serially interconnected. Each panel of the sofa-sleeper deck comprises a series of spaced, parallel, longitudinal wires and a series of spaced, parallel, transverse wires all of which are welded at their intersections. Additionally, a border wire extends around the perimeter of each panel and is welded at its intersections to both the longitudinal and transverse wires.

Each panel of the sofa-sleeper deck is hingedly interconnected with the adjacent panels. In order to provide for individual articulation of each panel and pivotal movement of the panel with respect to the adjacent panels, the longitudinal wires of at least one panel extend beyond the border wire of that panel and are wrapped around the border wire of the adjacent panel to provide for a hinged interconnection of the adjacent panels.

The welded wire grid panels of the sofa-sleeper deck of this invention may be used to comfortably support a mattress resting directly upon the welded wire grid panels or in combination with a cloth deck located atop the wire grid panels.

BRIEF DESCRIPTION OF THE DRAWINGS

The objectives and features of this invention will become more readily apparent from the following detailed description taken in conjunction with the accompanying drawings in which.

DETAILED DESCRIPTION OF THE INVENTION

Figure 1:
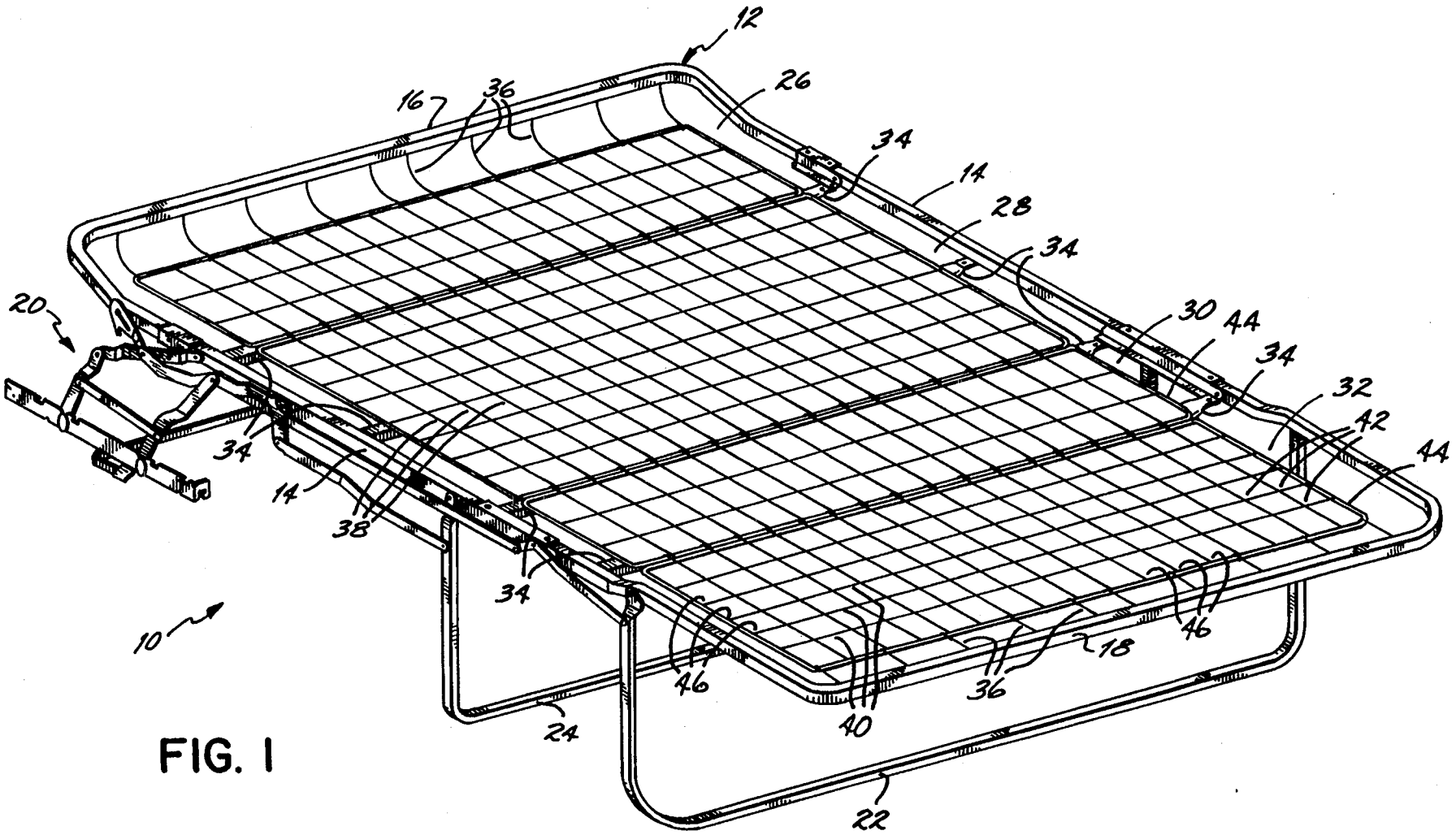
FIG. 1 is a perspective view of a sofa-sleeper deck in the extended bed configuration according to this invention.

Referring to FIG. 1, a sofa-sleeper deck 10 according to this invention is shown including a foldable bed frame 12 having opposed lateral side frame members 14, 14 extending between a head-end frame member 16 and a foot-end frame member 18. The bed frame 12 is foldable to and between a collapsed sofa configuration (not shown) and an extended generally flat bed configuration as shown in FIG. 1. To facilitate the collapsing and unfolding of the bed frame 12 to and between the sofa and bed configurations, a multibar linkage 20 is connected to both the bed frame 12 and the sofa (not shown). To support the bed frame 12 and sofa sleeper deck 10 in the bed configuration, forward and aft frame support members 22, 24, respectively, are pivotally attached to the side frame members 14, 14 to support the sofa-sleeper deck 10 on the floor. The sofa-sleeper deck 10 of this invention offers a generally flat and planar surface to support a mattress (not shown) to provide a comfortable sleeping surface.

The sofa-sleeper deck 10 of this invention includes serially and pivotally interconnected head panel 26, body panel 28, intermediate panel 30 and foot panel 32 sections. The head panel 26 underlies the head of a person lying prone on the sofa-sleeper deck and the foot panel 32 supports the feet of the person. The body panel 28 and intermediate panel 30 support the torso and legs of the person, respectively. The sofa-sleeper deck 10 is supported by a number of cross-frame elements 34 extending between and connected to the side frame members 14, 14. The sofa-sleeper deck 10 is attached to the bed frame 12 at the head end 16 and foot end 18 thereof by a plurality of frame attaching wires 36.

It will be appreciated by one of ordinary skill in the art that the scope of this invention is not limited to the particular bed frame, multibar linkage, frame supporting members, cross-frame elements, or frame attaching wires described herein or shown in FIG. 1.

Figure 2:
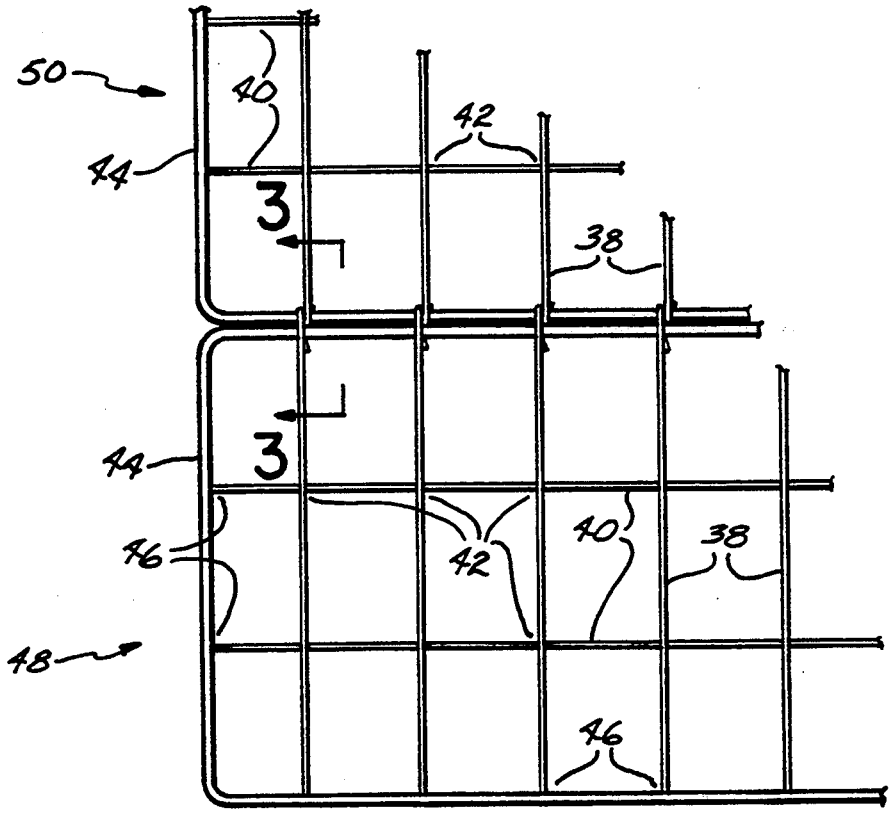
FIG. 2 is a partial plan view of adjacent wire grid panels of the sofa-sleeper deck of FIG. 1.

As shown in FIGS. 1 and 2, each panel 26, 28, 30, 32 in the sofa-sleeper deck 10 of this invention includes a plurality of generally parallel longitudinal wires 38 and a plurality of generally parallel transverse wires 40. To provide for a more resilient sofa-sleeper deck 10 and to avoid squeaking or other noises generated by the interaction of the transverse wires 40 with the longitudinal wires 38, the wires are secured, preferably by welding, to each other at each intersection 42 thereof.

A perimeter border wire 44 extends around the periphery of each panel 26, 28, 30, 32 in the sofa-sleeper deck 10 of this invention. The longitudinal and transverse wires 38, 40 are secured, preferably by welding, at each intersection 46 with the border wire.

Figure 3:
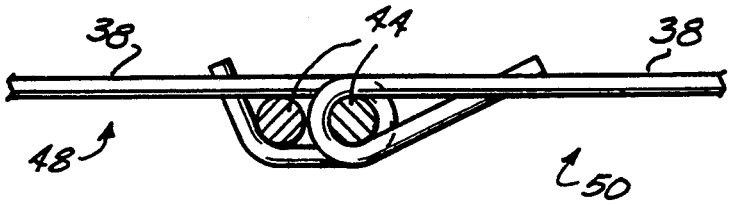
FIG. 3 is a partial cross-section view of the hinged interconnection of the adjacent panels of FIG. 2.

To provide for individual articulation of each panel 26, 28, 30, 32 and for pivotal movement of each panel 26, 28, 30, 32 relative to the adjacent panel, the panels 26, 28, 30, 32 are hingedly interconnected as shown in FIGS. 2 and 3. The longitudinal wires 38 of a first panel 48 extend beyond the border wire 44 of that panel 48 toward an adjacent panel 50. The extended longitudinal wires 38 are wrapped circumferentially around the border wire 44 of the adjacent panel 50 to thereby hingedly interconnect the adjacent panels 48, 50. The extended longitudinal wire 38 as shown in FIG. 3 is wrapped about both the border wire 44 on the adjacent panel 50 and the border wire 44 of the panel 48 from which the extended longitudinal wire 38 originates. As a result, the sofa-sleeper deck 10 and individual panels 26, 28, 30, 32 of this invention can be conveniently and easily transformed to and between the collapsed sofa configuration and the extended bed configuration shown in FIG. 1.

From the above disclosure of the general principles of this invention and the preceding detailed description of a preferred embodiment, those skilled in the art will readily comprehend the various modifications to which the present invention is susceptible. Therefore, we desire to be limited only by the scope of the following claims and equivalents thereof.

We claim:

1. A sofa-sleeper bed comprising:

a foldable bed frame; and a plurality of serially interconnected panels being attached to said bed frame, said panels being pivotal relative to one another to and between a folded sofa configuration and an extended generally flat bed configuration, each said panel having a plurality of longitudinal wires, a plurality of transverse wires, and a peripheral border wire extending around the perimeter of each said panel to which each said longitudinal wire and each said transverse wire is secured.

2. The sofa-sleeper bed of claim 1 wherein each said panel is hingedly connected to an adjacent said panel such that at least one of said longitudinal wires in a first panel extends beyond said border wire of said first panel to wrap around said border wire of an adjacent said panel.

3. The sofa-sleeper of claim 1 wherein said plurality of panels comprise serially interconnected head, body, intermediate and foot panels.

4. The sofa-sleeper of claim 1 wherein said longitudinal wires are secured to said transverse wires at each intersection thereof.

5. The sofa-sleeper of claim 1 wherein said longitudinal wires are welded to said transverse wires at each intersection thereof.

6. The sofa-sleeper of claim 1 wherein each said longitudinal wire and each said transverse wire is welded to said border wire.

7. A sofa-sleeper bed comprising:

a foldable bed frame; and a plurality of serially interconnected panels being attached to said bed frame, said panels being pivotal relative to one another to and between a folded sofa configuration and an extended generally flat bed configuration, each said panel having a plurality of longitudinal wires, a plurality of transverse wires, and a peripheral border wire extending around the perimeter of each said panel to which each said longitudinal wire and each said transverse wire is welded, each said longitudinal wire being welded to each said transverse wire at an intersection thereof, each said panel being hingedly connected to an adjacent said panel such that at least one of said longitudinal wires in a first panel extends beyond said border wire of said first panel to wrap around said border wire of an adjacent said panel.

8. A sofa-sleeper bed comprising:

a foldable bed frame having four foldable bed frame sections; and four serially interconnected panels being attached to said bed frame, each said panel being coextensive with a corresponding said bed frame section and being pivotal about an axis with respect to both said panel and said corresponding said bed frame section, said panels being pivotal relative to one another to and between a folded sofa configuration and an extended generally flat bed configuration, each said panel having a plurality of longitudinal wires, a plurality of transverse wires, and a peripheral border wire extending around the perimeter of each said panel to which each said longitudinal wire and each said transverse wire is secured.

* * * * *